US011228103B2

(12) United States Patent
Wang et al.

(10) Patent No.: US 11,228,103 B2
(45) Date of Patent: Jan. 18, 2022

(54) WAVEGUIDE FEED SUBSTRATE AND MANUFACTURING METHOD THEREOF, AND ANTENNA SYSTEM AND MANUFACTURING METHOD THEREOF

(71) Applicants: BEIJING BOE SENSOR TECHNOLOGY CO., LTD., Beijing (CN); BOE TECHNOLOGY GROUP CO., LTD., Beijing (CN)

(72) Inventors: Ying Wang, Beijing (CN); Tienlun Ting, Beijing (CN); Jie Wu, Beijing (CN); Xue Cao, Beijing (CN); Peizhi Cai, Beijing (CN); Chuncheng Che, Beijing (CN); Hao Liu, Beijing (CN); Liang Li, Beijing (CN); Haocheng Jia, Beijing (CN)

(73) Assignees: BEIJING BOE SENSOR TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/639,312

(22) PCT Filed: Aug. 9, 2019

(86) PCT No.: PCT/CN2019/100026
§ 371 (c)(1),
(2) Date: Feb. 14, 2020

(87) PCT Pub. No.: WO2020/030128
PCT Pub. Date: Feb. 13, 2020

(65) Prior Publication Data

US 2020/0251817 A1 Aug. 6, 2020

(30) Foreign Application Priority Data

Aug. 10, 2018 (CN) ..... 201810911924.5

(51) Int. Cl.
*H01Q 1/50* (2006.01)
*H01Q 1/38* (2006.01)

(52) U.S. Cl.
CPC ..... *H01Q 1/50* (2013.01); *H01Q 1/38* (2013.01)

(58) Field of Classification Search
CPC ..... H01Q 1/50; H01Q 1/38; H01Q 9/0457; H01P 11/002; H01P 1/184
See application file for complete search history.

(56) References Cited

U.S. PATENT DOCUMENTS

2020/0066661 A1* 2/2020 Tschumakow ..... H01P 7/065

FOREIGN PATENT DOCUMENTS

CN 1338793 A 3/2002
CN 107895830 A 4/2018
(Continued)

*Primary Examiner* — Seung H Lee
(74) *Attorney, Agent, or Firm* — Nath, Goldberg & Meyer; Joshua B. Goldberg

(57) ABSTRACT

A waveguide feed substrate and a manufacturing method thereof, and an antenna system and a manufacturing method thereof are provided. The waveguide feed substrate comprises: a first base substrate provided with a receiving groove; and a waveguide feeder embedded in the receiving groove and provided with a first side disposed at a bottom of the receiving groove, a second side disposed opposite to the first side, a third side disposed on a first side wall of the receiving cell, and a fourth side disposed on a second side wall of the receiving cell; wherein an opening is disposed in the second side, and an upper surface of the second side is flush with an upper surface of the first base substrate.

20 Claims, 9 Drawing Sheets

(56) References Cited

FOREIGN PATENT DOCUMENTS

| | | | |
|---|---|---|---|
| CN | 208889844 | U | 5/2019 |
| CN | 109950697 | A | 6/2019 |
| JP | 2009253940 | A | 10/2009 |

* cited by examiner 11
1

23
24
21
1

4
23
24
21
1

22
221
23
24
21
1

22
221
23
24
21
1

WAVEGUIDE FEED SUBSTRATE AND MANUFACTURING METHOD THEREOF, AND ANTENNA SYSTEM AND MANUFACTURING METHOD THEREOF

CROSS-REFERENCE TO RELATED APPLICATION

This is a National Phase Application filed under 35 U.S.C. 371 as a national stage of PCT/CN2019/100026, filed Aug. 9, 2019, an application claiming priority to Chinese Application No. 201810911924.5, filed Aug. 10, 2018, the contents of each of which are incorporated herein in their entirety by reference.

TECHNICAL FIELD

The present disclosure belongs to the field of communication technology, and particularly relates to a waveguide feed substrate and a manufacturing method thereof, and an antenna system and a manufacturing method thereof.

BACKGROUND

Currently, a liquid crystal antenna is mainly fed by a microstrip line and a Substrate Integrated Waveguide (SIW). Feeding by a microstrip line has the characteristics of relatively high isolation and integration, but has the disadvantages of relatively high insertion loss. Feeding by an SIW is characterized in that it can replace a rectangular waveguide, and is superior to a traditional rectangular metal waveguide in terms of section size, loss characteristics, processing cost and integration capability. However, most SIW feeders are manufactured by forming through holes in dielectric slabs and plating upper and lower metal layers, and have performance similar to that of the metal waveguide, and most dielectric slabs are Printed Circuit Boards (PCBs). Due to the material characteristics of glass, i.e., it is not easy to be integrated with substrates such as PCBs. For integrating a glass structure with a PCB structure, a fixing frame or other means are required to fix them together, which results in relatively poor assembly accuracy. Because a feed position requires higher alignment precision, it is easy to generate relatively large loss if the alignment precision is low.

SUMMARY

According to an embodiment of the present disclosure, there is provided a waveguide feed substrate including: a first base substrate provided with a receiving groove which includes a bottom, and a first side wall and a second side wall which are connected to the bottom and disposed opposite to each other; and a waveguide feeder which is embedded in the receiving groove, is a hollow structure and is provided with a first side disposed at the bottom of the receiving groove, a second side disposed opposite to the first side, and a third side and a fourth side which are both connected between the first side and the second side and disposed opposite to each other; wherein, the third side is disposed on the first side wall and the fourth side is disposed on the second side wall; and an opening is formed in the second side, and an upper surface of the second side distal to the first side is flush with an upper surface of the first base substrate on which the receiving groove is provided.

According to an embodiment of the present disclosure, a second base substrate is disposed on a side of the second side of the waveguide feeder distal to the first side, and the second base substrate is connected to the upper surface of the first base substrate, on which the receiving groove is provided, by bonding.

According to an embodiment of the present disclosure, materials of the first base substrate and the second base substrate both include: any one of glass, silicon, quartz, and ceramic, and a material of the waveguide feeder includes metal.

According to an embodiment of the present disclosure, there is provided an antenna system including the waveguide feed substrate described above, and an antenna substrate bonded to the waveguide feed substrate.

According to an embodiment of the present disclosure, the antenna substrate includes: a third base substrate; a microstrip line disposed on a side of the third base substrate distal to the waveguide feed substrate; a fourth base substrate; a patch electrode disposed on a first side of the fourth base substrate; a metal patch disposed on a second side of the fourth base substrate; and a liquid crystal layer disposed between a side of the third base substrate provided with the microstrip line and a side of the fourth base substrate provided with the patch electrode, wherein an orthographic projection of the microstrip line on the third base substrate partially overlaps an orthographic projection of the opening of the second side of the waveguide feed substrate on the third base substrate; the patch electrode is provided with an opening, and an orthographic projection of the metal patch on the fourth base substrate partially overlaps an orthographic projection of the opening of the patch electrode on the fourth base substrate; an orthographic projection of the microstrip line on the fourth base substrate partially overlaps the orthographic projection of the opening of the patch electrode on the fourth base substrate; and an orthographic projection of the opening of the second side of the waveguide feed substrate on the fourth base substrate does not overlap the orthographic projection of the opening of the patch electrode on the fourth base substrate.

According to an embodiment of the present disclosure, a material of the third base substrate includes glass.

According to an embodiment of the present disclosure, there is provided a method for manufacturing a waveguide feed substrate. The waveguide feed substrate includes a first base substrate provided with a receiving groove, and a waveguide feeder embedded in the receiving groove, and the waveguide feeder is a hollow structure, and is provided with a first side disposed at a bottom of the receiving groove, a second side disposed opposite to the first side and provided with an opening, and a third side and a fourth side which are both connected between the first side and the second side and disposed opposite to each other. The method for manufacturing the waveguide feed substrate includes: providing a first base substrate, and etching the first base substrate to form a receiving groove therein, wherein the receiving groove includes: a bottom, and a first side wall and a second side wall which are connected to the bottom and disposed opposite to each other; growing metal on the bottom, the first side wall and the second side wall of the receiving groove to form a first side, a third side and a fourth side of a waveguide feeder; forming a sacrificial structure that fills the receiving groove where the first side, the third side, and the fourth side of the waveguide feeder are formed, wherein an upper surface of the sacrificial structure is flush with upper surfaces of the third side and the fourth side to expose the upper surfaces of the third side and the fourth side; forming a pattern of a second side of the waveguide feeder by a patterning process, wherein the second side is provided with an opening and is connected to the third side and the fourth side to form a hollow structure with the first side, the third side, and the fourth side, and an upper surface of the second side distal to the first side is flush with an upper surface of the first base substrate on which the receiving groove is provided; and removing the sacrificial structure through the opening in the second side to form the waveguide feeder.

According to an embodiment of the present disclosure, the step of growing metal on the bottom, the first side wall and the second side wall of the receiving groove includes forming a metal material layer by an electroplating process to integrally form the first side, the third side and the fourth side of the waveguide feeder.

According to an embodiment of the present disclosure, the step of forming a sacrificial structure includes depositing a sacrificial layer material on the first base substrate provided with the receiving groove where the first side, the third side and the fourth side of the waveguide feeder are formed, and removing the sacrificial layer material located outside the receiving groove to form a sacrificial structure which fully fills the receiving groove.

According to an embodiment of the present disclosure, the sacrificial layer material includes any one of silicon dioxide and polysilicon.

According to an embodiment of the present disclosure, the step of forming a pattern of a second side of the waveguide feeder by a patterning process includes depositing a metal material layer by a sputtering or electroplating process, and forming a pattern of a second side by exposure, development and etching processes.

According to an embodiment of the present disclosure, the step of removing the sacrificial structure through the opening in the second side includes: removing the sacrificial structure through the opening in the second side by an etching process.

According to an embodiment of the present disclosure, there is provided a method for manufacturing a waveguide feed substrate. The waveguide feed substrate includes a first base substrate provided with a receiving groove, and a waveguide feeder embedded in the receiving groove. The waveguide feeder is a hollow structure, and is provided with a first side disposed at a bottom of the receiving groove, and a third side and a fourth side where are connected to the first side and disposed opposite to each other, and the waveguide feeder is further provided with a second side disposed opposite to the first side and the second side is provided with an opening, the second side is located on a second base substrate and is connected to the third side and the fourth side respectively, and a surface of the second base substrate on which the second side is provided is bonded to and fixed with an upper surface of the first substrate on which the receiving groove is provided. The method for manufacturing the waveguide feed substrate includes: providing a first base substrate, and etching the first base substrate to form a receiving groove therein, wherein the receiving groove includes: a bottom, and a first side wall and a second side wall which are connected to the bottom and disposed opposite to each other; growing metal on the bottom, the first side wall and the second side wall of the receiving groove to form a first side, a third side and a fourth side of a waveguide feeder; providing a second base substrate, and forming a pattern including a second side of the waveguide feeder on the second base substrate by a patterning process, wherein the second side is provided with an opening, and a thickness of the second side is equal to a distance between upper surfaces of the third side and the fourth side and an upper surface of the first base substrate; performing a bonding process on the first base substrate on which the first side, the third side and the fourth side of the waveguide feeder are formed and the second base substrate on which the second side of the waveguide feeder is formed, so as to form the waveguide feeder, wherein the second side is connected to the third side and the fourth side to form a hollow structure with the first side, the third side and the fourth side, and the upper surface of the first base substrate is in contact with the second base substrate.

According to an embodiment of the present disclosure, the step of growing metal growth on the bottom, the first side wall and the second side wall of the receiving groove includes forming a metal material layer by an electroplating process to integrally form the first side, the third side and the fourth side of the waveguide feeder, and the step of forming a pattern including a second side of the waveguide feeder on the second base substrate by a patterning process includes depositing a metal material layer by a sputtering or electroplating process, and forming a pattern of a second side by exposure, development, and etching processes.

According to an embodiment of the present disclosure, there is provided a method for manufacturing an antenna system. The antenna system includes a waveguide feed substrate and an antenna substrate bonded to the waveguide feed substrate. The method for manufacturing an antenna system includes the method for manufacturing a waveguide feed substrate, the method for manufacturing an antenna substrate, and the method for fixing the waveguide feed substrate and the antenna substrate described above. The method for manufacturing an antenna substrate includes: providing a third base substrate; growing metal on one surface of the third base substrate, and patterning the grown metal to form a microstrip line; providing a fourth base substrate; growing metal on two opposite surfaces of the fourth base substrate, and patterning the metal grown on the two surfaces to form a patch electrode and a metal patch respectively, wherein the patch electrode is provided with an opening, and an orthographic projection of the metal patch on the fourth base substrate partially overlaps an orthographic projection of the opening of the patch electrode on the fourth base substrate; assembling the third base substrate and the fourth base substrate with a surface of the third base substrate provided with the microstrip line facing a surface of the fourth base substrate provided with the patch electrode to form a cell, and pouring liquid crystals into the cell, wherein an orthographic projection of the microstrip line on the fourth base substrate partially overlaps the orthographic projection of the opening of the patch electrode on the fourth base substrate, and the method for fixing the waveguide feed substrate and the antenna substrate includes fixing the upper surface of the first base substrate on which the receiving groove is provided in the waveguide feed substrate and a surface of the third base substrate not having the microstrip line in the antenna substrate by a bonding process, wherein an orthographic projection of the microstrip line on the third base substrate partially overlaps an orthographic projection of the opening of the second side of the waveguide feed substrate on the third base substrate, and an orthographic projection of the opening of the second side of the waveguide feed substrate on the fourth base substrate does not overlap the orthographic projection of the opening of the patch electrode on the fourth base substrate.

According to an embodiment of the present disclosure, there is provided a method for manufacturing an antenna system. The antenna system includes a waveguide feed substrate and an antenna substrate bonded to the waveguide feed substrate. The method for manufacturing an antenna system includes the method for manufacturing a waveguide feed substrate, the method for manufacturing an antenna substrate, and the method for fixing the waveguide feed substrate and the antenna substrate described above, wherein the method for manufacturing an antenna substrate includes: providing a third base substrate; growing metal on one surface of the third base substrate, and patterning the grown metal to form a microstrip line; providing a fourth base substrate; growing metal on two opposite surfaces of the fourth base substrate, and patterning the metal grown on the two surfaces to form a patch electrode and a metal patch respectively, wherein the patch electrode is provided with an opening, and an orthographic projection of the metal patch on the fourth base substrate partially overlaps an orthographic projection of the opening of the patch electrode on the fourth base substrate; assembling the third base substrate and the fourth base substrate with a surface of the third base substrate provided with the microstrip line facing a surface of the fourth base substrate provided with the patch electrode to form a cell, and pouring liquid crystals into the cell, wherein an orthographic projection of the microstrip line on the fourth base substrate partially overlaps the orthographic projection of the opening of the patch electrode on the fourth base substrate, and the method for fixing the waveguide feed substrate and the antenna substrate includes fixing a surface of the second base substrate of the waveguide feed substrate distal to the second side in the waveguide fee substrate and a surface of the third base substrate not having the microstrip line in the antenna substrate by a bonding process, wherein an orthographic projection of the microstrip line on the third base substrate partially overlaps an orthographic projection of the opening of the second side of the waveguide feed substrate on the third base substrate, and an orthographic projection of the opening of the second side of the waveguide feed substrate on the fourth base substrate does not overlap the orthographic projection of the opening of the patch electrode on the fourth base substrate.

BRIEF DESCRIPTION OF THE DRAWINGS

FIGS. 8*a*, 8*b*, 8*c*, and 8*d* are flow charts illustrating processes of a method for manufacturing a waveguide feed substrate according to an embodiment of the present disclosure;

DETAILED DESCRIPTION

In order to enable those skilled in the art to better understand the technical solutions of the present disclosure, the present disclosure will be further described in detail below with reference to the accompanying drawings and specific implementations.

Unless otherwise defined, technical terms or scientific terms used in the embodiments should have general meanings that can be understood by people with ordinary skills in the technical field of the present disclosure. The words "first" and "second" and the like used in the embodiments do not denote any order, quantity, or importance, but are just used to distinguish between different elements. The word "include" or "comprise" and the like indicates that an element or object before the word covers elements or objects or the equivalents thereof listed after the word, but do not exclude other elements or objects. The word "connect" or "couple" and the like are not restricted to physical or mechanical connection, but may include electrical connection, whether direct or indirect. The words "on", "under", "left", "right" and the like are used merely to indicate relative positional relationships, and when an absolute position of an object described is changed, the relative positional relationships may also be changed accordingly.

It should be understood that when an element such as a layer, film, region, or substrate is referred to as being "on" or "under" another element, the element can be "directly" "on" or "under" another element, or there may be intermediate elements therebetween.

The term "bonding" in the present disclosure refers to a technique of subjecting two sheets of homogeneous or heterogeneous semiconductor materials, which have clean and atomically-flat surfaces, to surface cleaning and activation, and then directly combining under certain conditions, so as to bond the two wafers into a whole by Van der Waals force, molecular force or even atomic force.

Figure 1:
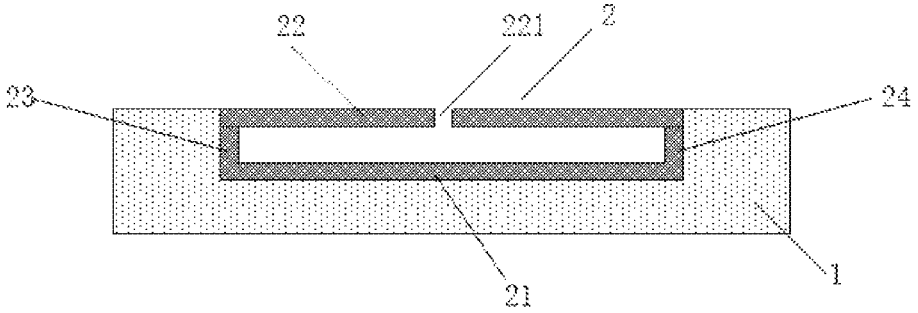
FIG. 1 is a schematic structural diagram of a waveguide feed substrate according to an embodiment of the present disclosure.
Figure 2:
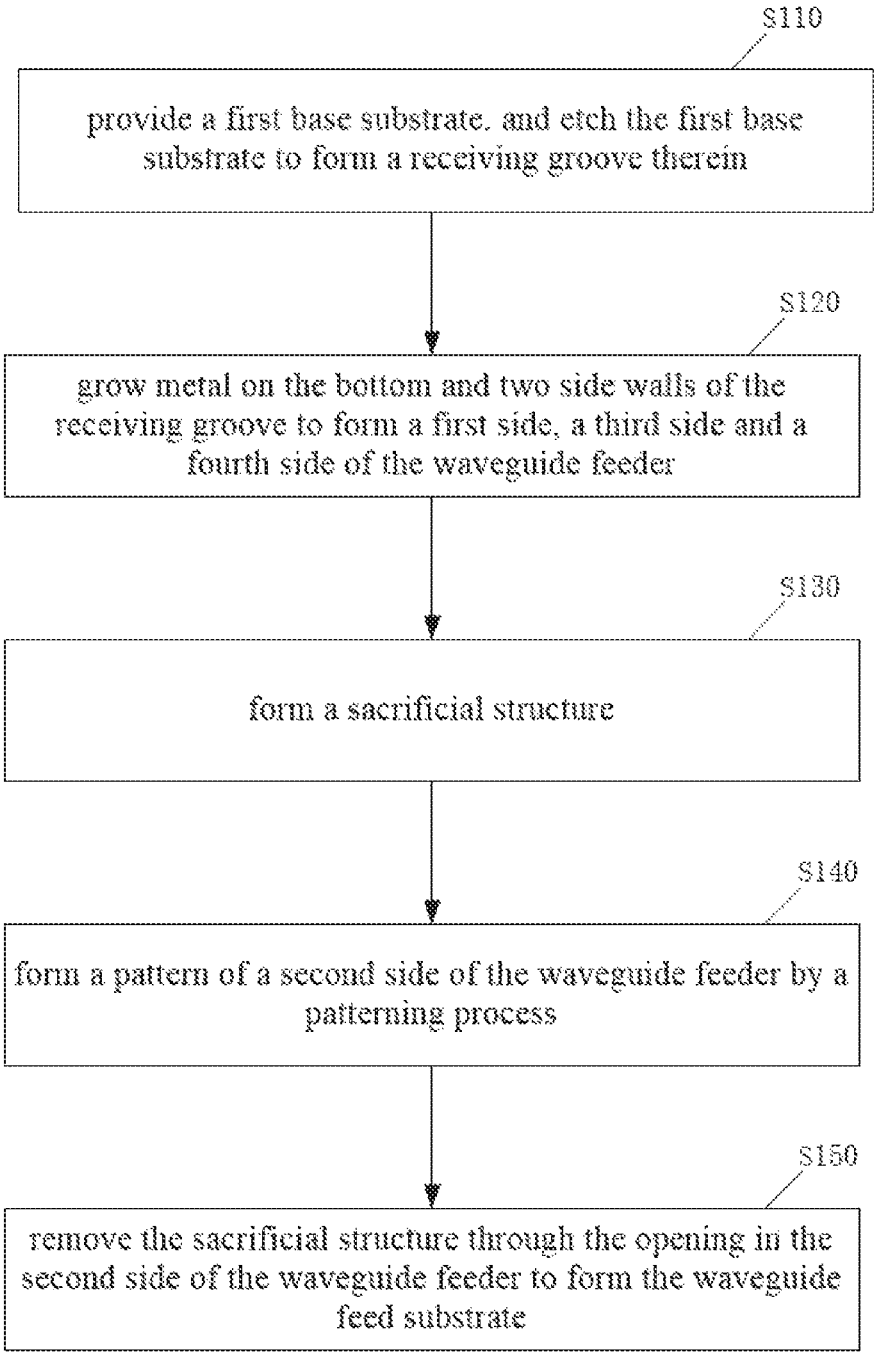
FIG. 2 is a flow chart of a method for manufacturing a waveguide feed substrate according to an embodiment of the present disclosure.
Figures 3A, 3B, 3C, 3D, 3E:
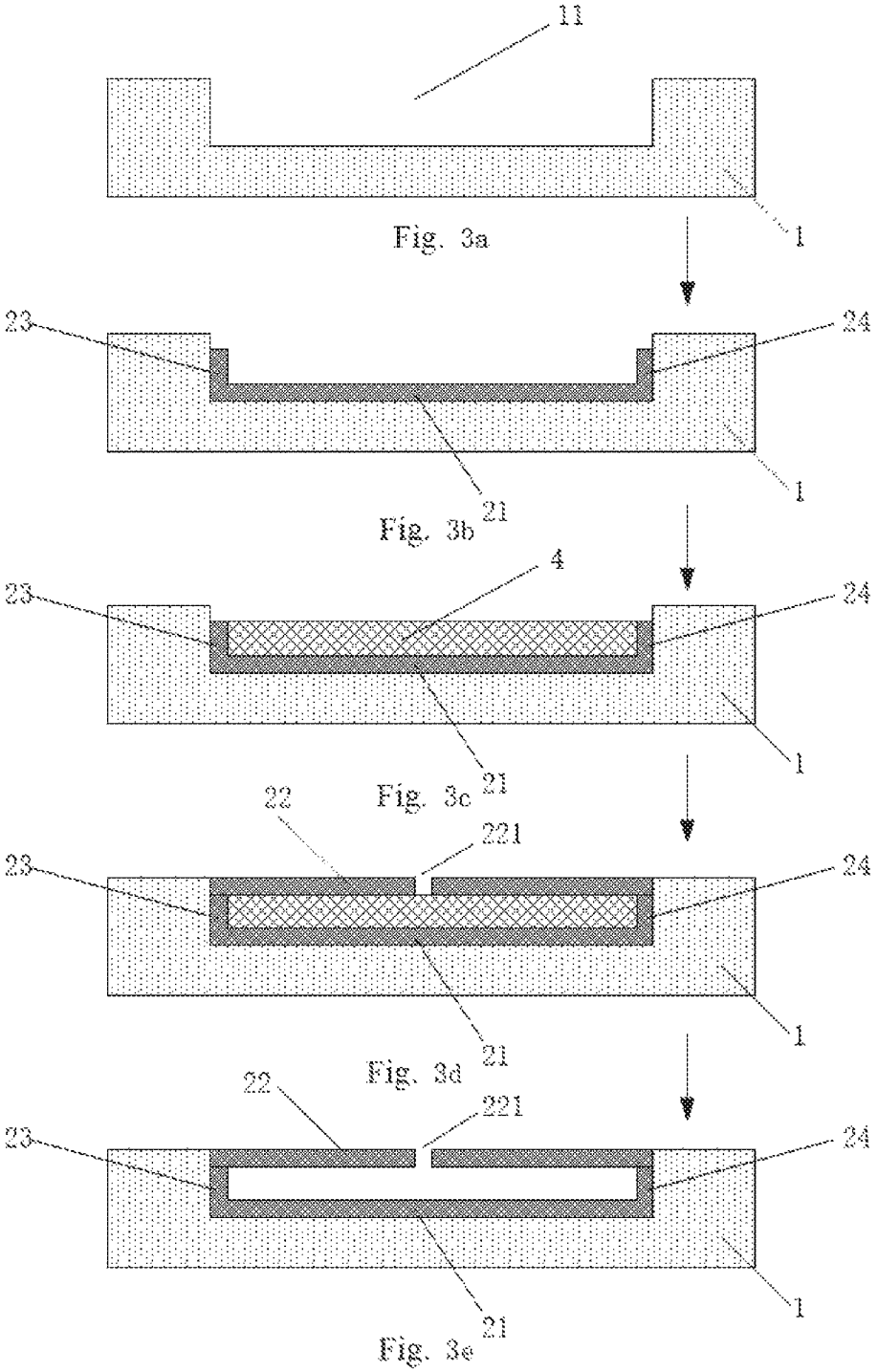
FIGS. 3*a*, 3*b*, 3*c*, 3*d*, and 3*e* are flow charts illustrating processes of a method for manufacturing a waveguide feed substrate according to an embodiment of the present disclosure.

As shown in FIG. 1, according to an embodiment of the present disclosure, there is provided a waveguide feed substrate including: a first base substrate 1 and a waveguide feeder 2. As shown in FIG. 3*a*, a receiving groove 11 is disposed on the first base substrate 1. The receiving groove 11 has a bottom, and a first side wall and a second side wall connected to the bottom and disposed opposite to each other (i.e., the receiving groove 11 is similar to a U-shaped groove). The waveguide feeder 2 is embedded in the receiving groove 11. The waveguide feeder 2 is a hollow structure having a first side 21 in contact with the bottom of the receiving groove 11, a second side 22 disposed opposite to the first side 21, and a third side 23 and a fourth side 24, which are both connected between the first side 21 and the second side 22, and disposed opposite to each other. The third side 23 is disposed on the first side wall of the receiving groove 11, the fourth side 24 is disposed on the second side wall, and an opening 221 is formed in the second side 22 of the feeder structure, and an upper surface of the second side 22 distal to the hollow structure is flush with an upper surface of the first base substrate 1 on which the receiving groove 11 is provided. The opening 221 is located in an orthographic projection of a microstrip line on the second side 22 (the opening 221 and the microstrip line are located on different planes), and can be configured to feed an electromagnetic wave signal into an access port of a microstrip line of a phase shifter, so that the electromagnetic wave signal is transmitted along an axial direction of the microstrip line.

Figure 4A:
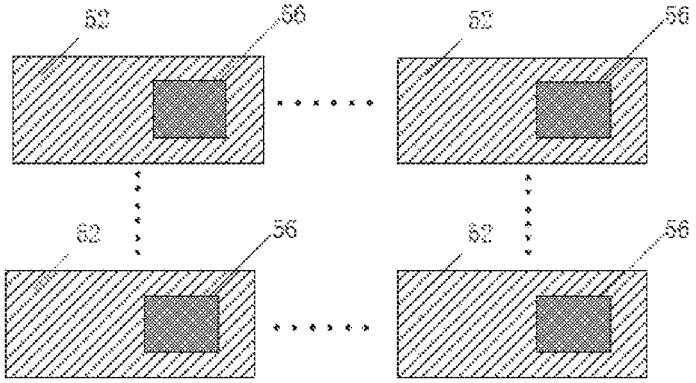
FIG. 4*a* is a schematic diagram of an antenna array according to an embodiment of the present disclosure.

The waveguide feeder 2 is applied to an antenna substrate, and the antenna substrate generally includes a phase shifter and a metal patch disposed on the phase shifter. As shown in FIG. 4*a*, antennas are generally arranged in an array. Of course, the antennas may be arranged in other ways. Taking a liquid crystal phase shifter as an example, as shown in FIG. 4*b* to FIG. 4*e*, the liquid crystal phase shifter generally includes a third base substrate 51 and a fourth base substrate 52, and a liquid crystal layer 53 between the third base substrate 51 and the fourth base substrate 52. A material of the fourth base substrate 52 may be the same as that of the third base substrate 51. The liquid crystal phase shifter further includes a microstrip line 54 located on a side of the third base substrate 51 close to the liquid crystal layer 53, a patch electrode 55 disposed on a side of the fourth base substrate 52 close to the liquid crystal layer 53, and a metal patch 56 disposed on a side of the fourth base substrate 52 distal to the liquid crystal layer 53. An orthographic projection of the microstrip line 54 on the third base substrate 51 partially overlaps an orthographic projection of the opening 221 of the second side 22 of the waveguide feed substrate on the third base substrate 51. The patch electrode 55 has an opening 551, and an orthographic projection of the metal patch 56 on the fourth base substrate 52 partially overlaps an orthographic projection of the opening 551 of the patch electrode 55 on the fourth base substrate 52. An orthographic projection of the microstrip line 54 on the fourth base substrate 52 partially overlaps the orthographic projection of the opening 551 of the patch electrode 55 on the fourth base substrate 52. An orthographic projection of the opening 221 of the second side 22 of the waveguide feed substrate on the fourth base substrate 52 does not overlap the orthographic projection of the opening 551 of the patch electrode 55 on the fourth base substrate 52. Thus, the electromagnetic wave signal reaches the microstrip line 54 through the opening 221, then is transmitted along an axis of the microstrip line 54 to reach the opening 551, then reaches the metal patch 56 through the opening 551, and finally is radiated out by the metal patch 56.

Since the waveguide feeder 2 is disposed in the first base substrate 1 in the waveguide feed substrate provided by the embodiment, a surface of the first base substrate 1 on which the waveguide feeder 2 is disposed and a surface of the third base substrate 51 distal to the microstrip line 54 in the antenna substrate 5 can be fixed together by a bonding process. The bonding process has high precision, and can form antenna systems having stable structures, and therefore, can greatly reduce loss and error of the antenna systems caused by mechanical assembly.

Since the microstrip line is generally formed on a glass base substrate, that is, a material of the third base substrate 51 of the antenna substrate 5 includes glass. Therefore, in some embodiments, materials capable of being bonded with glass are selected as the materials of the first base substrate 1. Specifically, the materials of the first base substrate 1 may include any one of glass, silicon, quartz, and ceramic.

In some embodiments, a material of the waveguide feeder 2 may include metal. Specifically, the metal materials may include copper, aluminum, and may also include invar and steel. Of course, the metal materials are not limited to the above materials, and different metal materials can be selected according to different application occasions and wave bands.

Correspondingly, according to an embodiment of the present disclosure, with respect to the waveguide feed substrate described above, as shown in FIG. 2 and FIGS. 3*a*-3*e*, a method for manufacturing the waveguide feed substrate is further provided, and specifically includes the following steps.

In step S110, a first base substrate 1 is provided, and is etched to form a receiving groove 11 therein. As shown in FIG. 3*a*, the receiving groove 11 includes a bottom, an opening 221 opposite to the bottom, and a first side wall and a second side wall which are connected to the bottom and disposed opposite to each other.

In step S120, metal growth is performed on the bottom and the two side walls of the receiving groove 11 on the base substrate where the above step is completed, so as to form a first side 21, a third side 23, and a fourth side 24 of a waveguide feeder 2. As shown in FIG. 3*b*, the first side 21 is formed on the bottom of the receiving groove 11, the third side 23 is formed on the first side wall of the receiving groove 11, and the fourth side 24 is formed on the second side wall of the receiving groove 11. Moreover, upper surfaces of the third side 23 and the fourth side 24 of the waveguide feeder 2 are lower than an upper surface of the first base substrate 1 where the receiving groove 11 is provided, so that a second side 22 is formed within a range formed by a distance between the upper surfaces of the third side 23 and the fourth side 24 and the upper surface of the first base substrate 1 in the following steps.

Specifically, a layer of metal material is plated on the bottom, the first side wall and the second side wall of the receiving groove 11 by an electroplating process to form the first side 21, the third side 23, and the fourth side 24 of the waveguide feeder 2, so that the first side 21, the third side 23, and the fourth side 24 of the waveguide feeder 2 may be formed integrally.

It should be noted that the electroplating process refers to a method of laying a layer of metal on a conductor under the principle of electrolysis. Electroplating is a surface processing method in which a to-be-plated base metal is used as a cathode in a salt solution containing a pre-plated metal, and cations of the pre-plated metal in the plating solution are deposited on a surface of the base metal by electrolysis to form a plating layer.

Of course, the above step is not limited to employing the electroplating process, but can employ any process which can form metal layers on the bottom and the two side walls of the receiving groove 11.

In step S130, a sacrificial structure 4 is formed on the base substrate where the above steps are completed. As shown in FIG. 3*c*, the sacrificial structure 4 fills the receiving groove 11 where the first side 21, the third side 23 and the fourth side 24 of the waveguide feeder 2 are formed. An upper surface of the sacrificial structure 4 is flush with the upper surfaces of the third side 23 and the fourth side 24 to expose the upper surfaces of the third side 23 and the fourth side 24.

Specifically, a sacrificial layer material is deposited on the base substrate provided with the receiving groove 11 where the first side 21, the third side 23 and the fourth side 24 of the waveguide feeder 2 are formed, and the sacrificial layer material located outside the receiving groove 11 is removed to form the sacrificial structure 4 which fully fills a space formed by the first side 21, the third side 23 and the fourth side 24 of the waveguide feeder, and allow the upper surface of the sacrificial structure 4 to be flush with the upper surfaces of the third side 23 and the fourth side 24.

The sacrificial layer material may be any one of silicon dioxide, polysilicon, and the like.

In step S140, a pattern of the second side 22 of the waveguide feeder 2 is formed by a patterning process on the base substrate where the above steps are completed. As shown in FIG. 3*d*, the second side 22 is provided with an opening 221 thereon, and is connected to the third side 23 and the fourth side 24 to form a hollow structure with the first side 21, the third side 23 and the fourth side 24, with an upper surface of the second side 22 being flush with the upper surface of the first base substrate 1.

Specifically, a metal material layer is formed on the sacrificial structure 4 by a sputtering or electroplating process, and then the second side 22 of the waveguide feeder 2 is formed by exposure, development, and etching processes. It should be noted that formation of the metal material layer is not limited to employing sputtering and electroplating processes, but can employ any other process capable of depositing a metal film layer.

In step S150, the sacrificial structure 4 is removed through the opening 221 in the second side 22 of the waveguide feeder 2 to form the waveguide feeder 2, as shown in FIG. 3*e*.

The sacrificial structure 4 may be released by a dry etching process or a wet etching process to form the waveguide feeder.

Figure 4B:
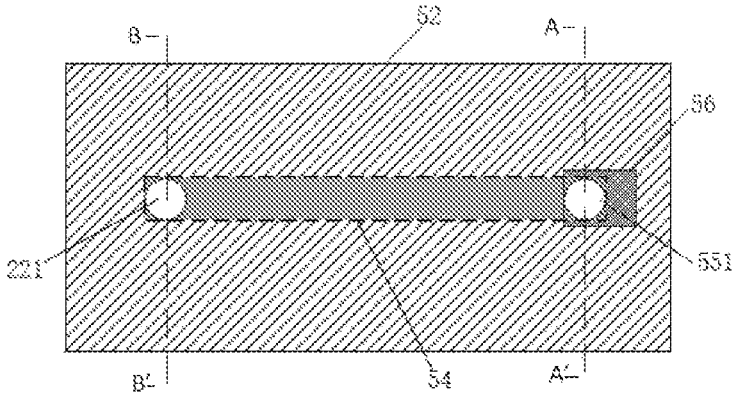
FIG. 4*b* is a schematic diagram of a plane structure of an antenna system according to an embodiment of the present disclosure.
Figure 4C:
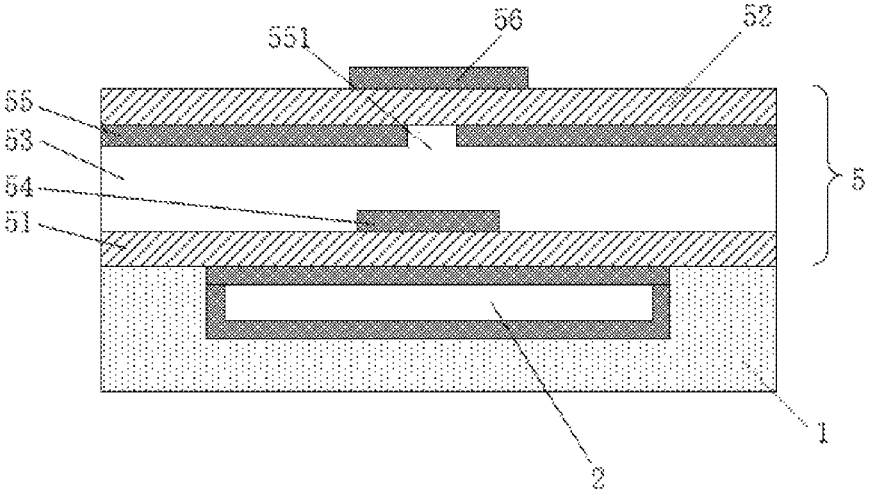
FIG. 4*c* is a schematic diagram of a section structure alone line A-A' of FIG. 4*b* according to an embodiment of the present disclosure.
Figure 4D:
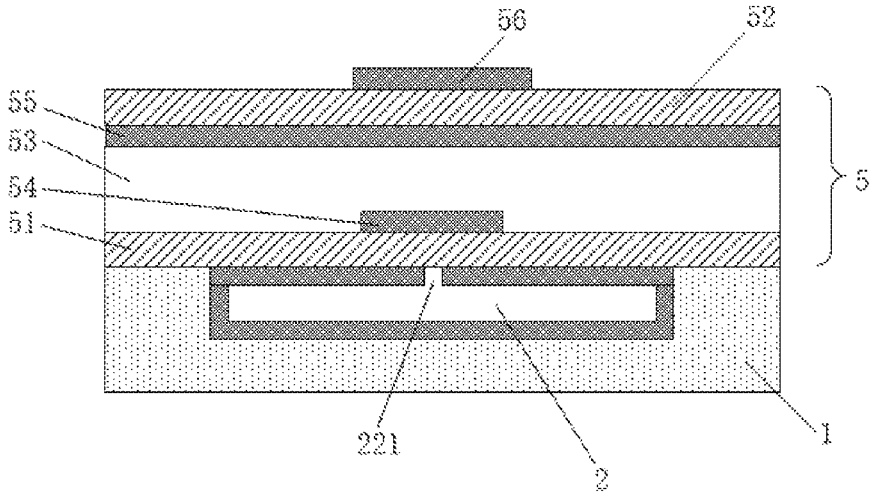
FIG. 4*d* is a schematic diagram of a section structure along line B-B' of FIG. 4*b* according to an embodiment of the present disclosure.
Figure 4E:
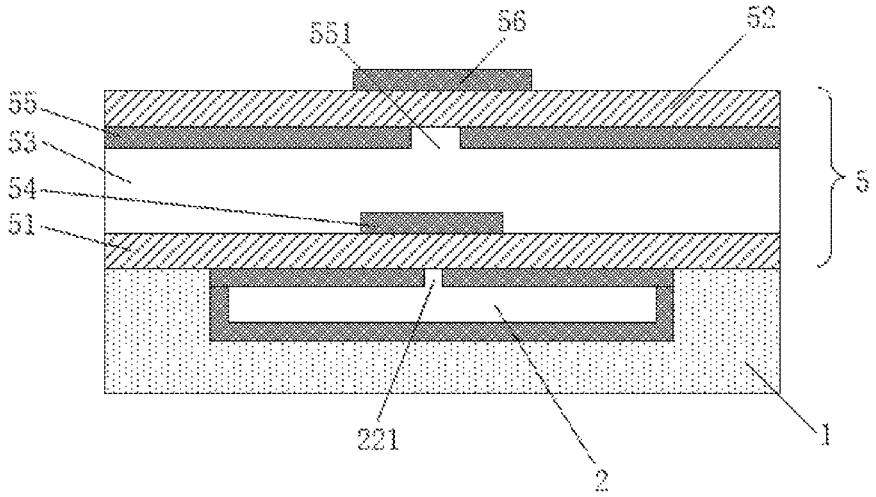
FIG. 4*e* is an assembly diagram of a section structure of the antenna substrate along line A-A' of FIG. 4*b* and a section structure of the waveguide feed substrate along line B-B' of FIG. 4*b* according to an embodiment of the disclosure.

Accordingly, according to an embodiment of the present disclosure, with regard to the waveguide feeder 2 described above, an antenna system is further provided. The antenna system includes the waveguide feed substrate described above, and an antenna substrate 5. FIG. 4*b* shows that a metal patch 56 and a fourth base substrate 52 are visible when the antenna system is viewed from the top, and further shows part of an internal structure of the antenna system in dotted lines. The internal structure shown in the dotted lines includes an opening 221 and an opening 551 which do not overlap each other, and a microstrip line 54, which connects the opening 221 and the opening 551, has an orthographic projection on a third base substrate 51 that partially overlaps orthographic projections of the two openings on the third base substrate 51. FIG. 4*c* shows a schematic diagram of a section structure alone line A-A' of FIG. 4*b*. FIG. 4*d* shows a schematic diagram of a section structure along line B-B' of FIG. 4*b*. FIG. 4*e* shows an assembly diagram of a section structure of the antenna substrate along line A-A' of FIG. 4*b* and a section structure of the waveguide feed substrate along line B-B' of FIG. 4*b*. For easy illustration, the present disclosure is described based on FIG. 4*e*. It should be noted that FIG. 4*e* is an assembly diagram of different parts of the antenna system taken along different lines, and does not represent an actual section structure.

Since the antenna system in the embodiment includes the waveguide feed substrate described above, a surface of the first base substrate 1 provided with the waveguide feeder 2 and a surface of the third base substrate 51 distal to the microstrip line 54 in the antenna substrate 5 can be fixed together by a bonding process. The bonding process has high precision, and can form antenna systems having stable structures, and therefore, can greatly reduce loss and error of the antenna systems caused by mechanical assembly.

Figure 5:
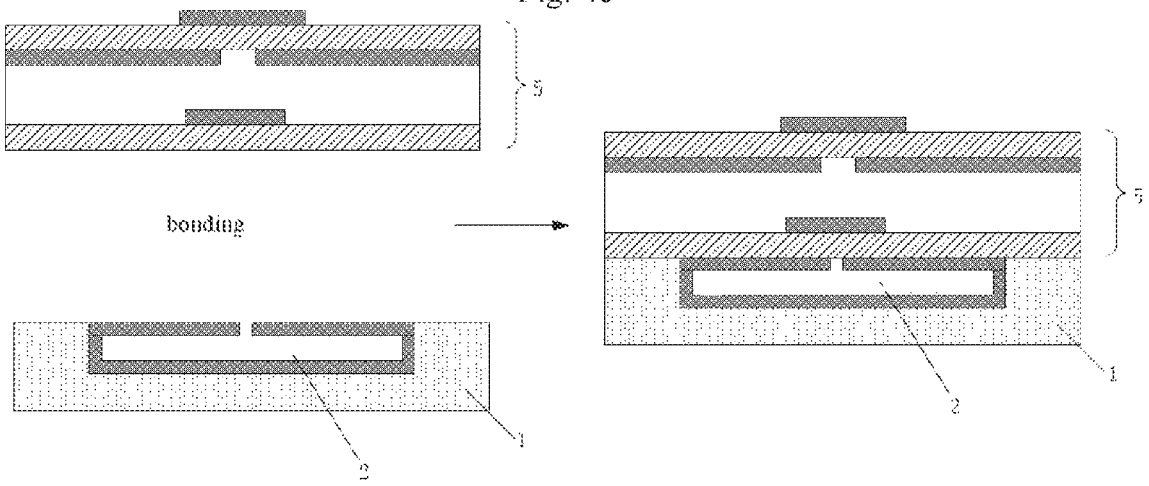
FIG. 5 is a flow chart illustrating processes of a method for manufacturing an antenna system according to an embodiment of the present disclosure.

Correspondingly, according to an embodiment of the present disclosure, with regard to the antenna system described above, a method for manufacturing the antenna system is further provided. The waveguide feed substrate in the antenna system may be manufactured by the method described above. As shown in FIG. 5, the method for manufacturing the antenna system specifically includes fixing a manufactured antenna substrate 5 and the waveguide feed substrate together by a bonding process.

As shown in FIG. 4*e*, for example, the antenna substrate 5 consists of a phase shifter and a metal patch provided on the phase shifter. The liquid crystal phase shifter generally includes a third base substrate 51 and a fourth base substrate 52, and a liquid crystal layer 53 between the third base substrate 51 and the fourth base substrate 52. A material of the fourth base substrate 52 may be the same as that of the third base substrate 51. The liquid crystal phase shifter further includes a microstrip line 54 located on a side of the third base substrate 51 close to the liquid crystal layer 53, a patch electrode 55 disposed on a side of the fourth base substrate 52 close to the liquid crystal layer 53, and a metal patch 56 disposed on a side of the fourth base substrate 52 distal to the liquid crystal layer 53. An orthographic projection of the microstrip line 54 on the third base substrate 51 partially overlaps an orthographic projection of the opening 221 of the second side 22 of the waveguide feed substrate on the third base substrate 51. The patch electrode 55 has an opening 551, and an orthographic projection of the metal patch 56 on the fourth base substrate 52 partially overlaps an orthographic projection of the opening 551 of the patch electrode 55 on the fourth base substrate 52. An orthographic projection of the microstrip line 54 on the fourth base substrate 52 partially overlaps the orthographic projection of the opening 551 of the patch electrode 55 on the fourth base substrate 52. An orthographic projection of the opening 221 of the second side 22 of the waveguide feed substrate on the fourth base substrate 52 does not overlap the orthographic projection of the opening 551 of the patch electrode 55 on the fourth base substrate 52. Thus, the electromagnetic wave signal reaches the microstrip line 54 through the opening 221, then is transmitted along an axis of the microstrip line 54 to reach the opening 551, then reaches the metal patch 56 through the opening 551, and finally is radiated out by the metal patch 56.

Thus, during a bonding process, a surface of the first base substrate 1 of the waveguide feed substrate on which the waveguide feeder 2 faces a surface of the third base substrate 51 of the antenna substrate 5 distal to the microstrip line 54, so as to fix the waveguide feed substrate and the antenna substrate 5 together. The bonding process has high precision, and can form antenna systems having stable structures, and therefore, can greatly reduce loss and error of the antenna systems caused by mechanical assembly.

Figure 6:
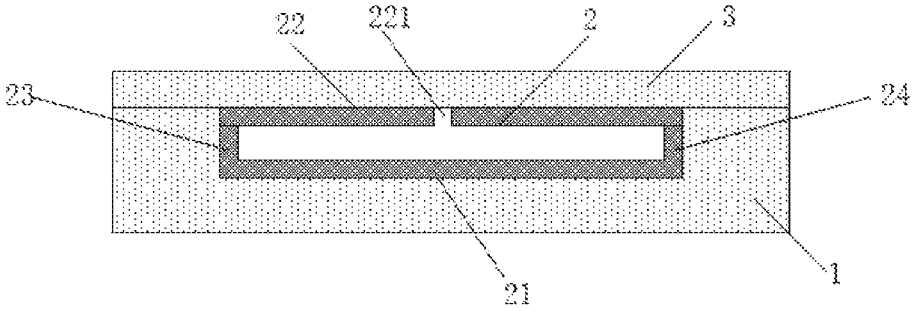
FIG. 6 is a schematic structural diagram of a waveguide feed substrate according to an embodiment of the present disclosure.

As shown in FIG. 6, according to an embodiment of the present disclosure, there is provided a waveguide feed substrate including a first base substrate 1 and a waveguide feeder 2. The first base substrate 1 is provided with a receiving groove 11. The receiving groove 11 includes a bottom, and a first side wall and a second side wall which are connected to the bottom and disposed opposite to each other. The waveguide feeder 2 is embedded in the receiving groove 11. The waveguide feeder 2 is a hollow structure having a first side 21 disposed at the bottom of the receiving groove 11, and a third side 23 and a fourth side 24 which are connected to the first side 21 and disposed opposite to each other. The third side 23 of the waveguide feeder is disposed on the first side wall, and the fourth side 24 is disposed on the second side wall. The waveguide feeder 2 is further provided with a second side 22 disposed opposite to the first side 21, the second side 22 being located on a second base substrate 3. A surface of the second base substrate 3 provided with the second side 22 is bonded to and fixed with an upper surface of the first base substrate 1 provided with the receiving groove 11. An opening 221 is provided in the second side 22, and the second side 22 is connected to the third side 23 and the fourth side 24 respectively. That is, compared with the waveguide feed substrate according to the embodiment illustrated in FIG. 1, the second base substrate 3 is provided on a side of the second side 22 of the waveguide feeder 2 distal to the first side 21, and the second base substrate 3 and the upper surface of the first base substrate 1 where the receiving groove is provided may be connected by bonding.

When the waveguide feed substrate in the embodiment and the antenna substrate 5 are fixed together, it is possible to fix a surface of the second base substrate 3 of the waveguide feed substrate distal to the second side 22 of the waveguide feeder with a surface of the third base substrate 51 not having the microstrip line 54 in the antenna substrate 5 by a bonding process. The bonding process has high precision, and can form antenna systems having stable structures, and therefore, can greatly reduce loss and error of the antenna systems caused by mechanical assembly.

The materials of the first base substrate 1 and the waveguide feeder 2 in the waveguide feed substrate of the embodiment can be the same as those in the above-described embodiments. The material of the second base substrate 3 may be the same as that of the first base substrate 1, i.e., a material capable of being bonded with glass is selected. Specifically, the material of the second base substrate 3 may include any one of glass, silicon, quartz, and ceramic.

Figure 7:
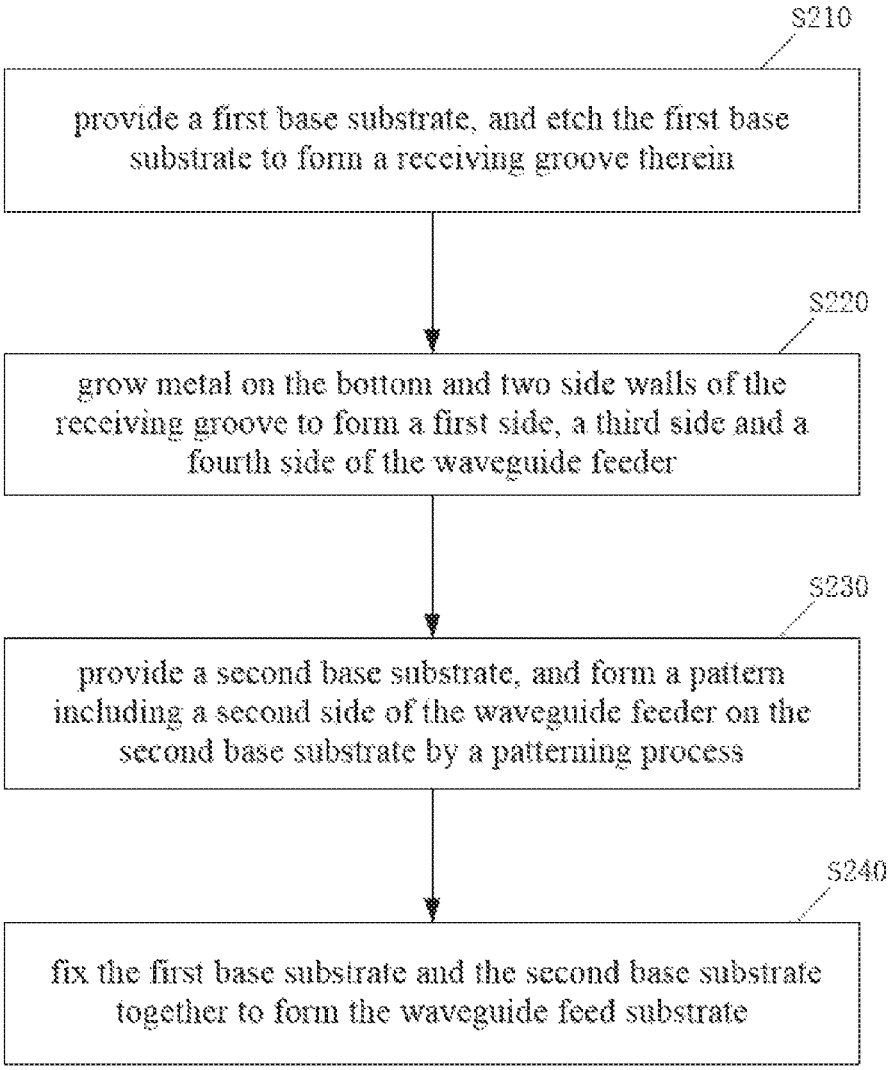
FIG. 7 is a flow chart of a method for manufacturing a waveguide feed substrate according to an embodiment of the present disclosure.

Correspondingly, according to an embodiment of the present disclosure, with regard to the waveguide feed substrate in FIG. 6, a method for manufacturing the waveguide feed substrate is further provided. As shown in FIG. 7, the manufacturing method specifically includes the following steps.

In step S210, a first base substrate 1 is provided, and is etched to form a receiving groove 11 therein. As shown in FIG. 8*a*, the receiving groove 11 includes a bottom, an opening opposite to the bottom, and a first side wall and a second side wall which are connected to the bottom and disposed opposite to each other.

In step S220, metal growth is performed on the bottom and the two side walls of the receiving groove 11 on the base substrate where the above step is completed, so as to form a first side 21, a third side 23, and a fourth side 24 of a waveguide feeder 2. As shown in FIG. 8*b*, the first side 21 is formed on the bottom of the receiving groove 11, the third side 23 is formed on the first side wall of the receiving groove 11, the fourth side 24 is formed on the second side wall of the receiving groove 11, and the third side 23 and the fourth side 24 are connected to the first side 21 respectively. Moreover, upper surfaces of the third side 23 and the fourth side 24 of the waveguide feeder 2 are lower than an upper surface of the first base substrate 1 where the receiving groove 11 is provided, so that a second side 22 is formed within a range formed by a distance between the upper surfaces of the third side 23 and the fourth side 24 and the upper surface of the first base substrate 1 in following steps.

Specifically, a layer of metal material is plated on the bottom, the first side wall and the second side wall of the receiving groove 11 by an electroplating process to form the first side 21, the third side 23, and the fourth side 24 of the waveguide feeder 2.

It should be noted that the electroplating process refers to a method of laying a layer of metal on a conductor under the principle of electrolysis. Electroplating is a surface processing method in which a to-be-plated base metal is used as a cathode in a salt solution containing a pre-plated metal, and cations of the pre-plated metal in the plating solution are deposited on a surface of the base metal by electrolysis to form a plating layer.

Of course, the above step is not limited to employing the electroplating process, but can employ any process which can form metal layers on the bottom and two side walls of the receiving groove 11.

In step S230, a second base substrate 3 is provided, and a pattern including the second side 22 of the waveguide feeder 2 is formed on the second base substrate 3 by a patterning process. As shown in FIG. 8*c*, the second side 22 of the waveguide feeder 2 is provided with an opening 221. In an embodiment, a thickness of the second side 22 of the waveguide feeder 2 on the second base substrate 3 is equal to the distance between the upper surfaces of the third side 23 and the fourth side 24 and the upper surface of the first base substrate 1. A width of the second side 22 may be equal to a width of the receiving groove 11.

Specifically, a metal material layer is formed on the second base substrate 3 by a sputtering or electroplating process, and then the second side 22 of the waveguide feeder 2 is formed by exposure, development, and etching processes. It should be noted that formation of the metal material layer is not limited to employing the sputtering and electroplating processes, but can employ any other process capable of depositing a metal film layer.

In step S240, the first base substrate 1 where the above steps are completed and the second base substrate 3 where the above steps are completed are fixed together to form a waveguide feed substrate.

Specifically, as shown in FIG. 8*d*, the first base substrate 1 where the above steps are completed and the second base substrate 3 where the above steps are completed may be fixed together by a bonding process to form the waveguide feed substrate. Since the thickness of the second side 22 of the waveguide feeder 2 on the second base substrate 3 is equal to the distance between the upper surfaces of the third side 23 and the fourth side 24 and the upper surface of the first base substrate 1, the second side 22 can be connected to the third side 23 and the fourth side 24, and a lower surface of the second base substrate 3 can be in contact with the upper surface of the first base substrate 1.

It should be noted that the step S230 may be implemented before the step S210. That is, the second side 22 of the waveguide feeder 2 on the second base substrate 3 may be manufactured before manufacturing the first side 21, the third side 23 and the fourth side 24 of the waveguide feeder 2 on the first base substrate 1.

Correspondingly, according to an embodiment of the present disclosure, with respect to the waveguide feed substrate of FIG. 6, an antenna system is further provided, and the antenna system includes the waveguide feed substrate of FIG. 6, and an antenna substrate 5.

Since the antenna system in the embodiment includes the waveguide feed substrate described above, a surface of the second base substrate 3 of the waveguide feeder 2 distal to the second side and a surface of the third base substrate 51 in the antenna substrate 5 distal to the microstrip line 54 can be fixed together by a bonding process. The bonding process has high precision, and can form antenna systems having stable structures, and therefore, can greatly reduce loss and error of the antenna system caused by mechanical assembly.

Figure 10:
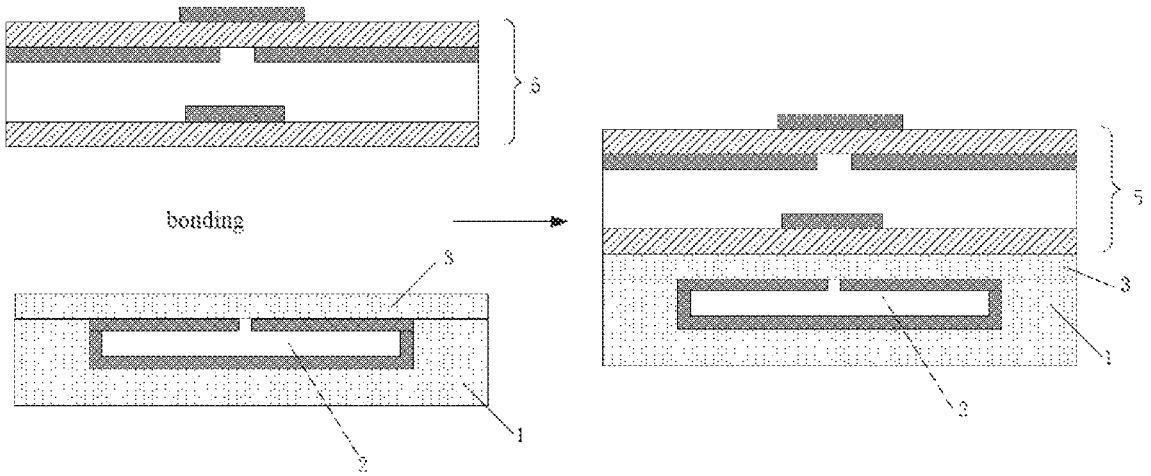
FIG. 10 is a flow chart illustrating processes of a method for manufacturing an antenna system according to an embodiment of the present disclosure.

Correspondingly, according to an embodiment of the disclosure, with regard to the antenna system, a method for manufacturing the antenna system is further provided. The waveguide feed substrate in the antenna system can be manufactured by the method described above. As shown in FIG. 10, the method for manufacturing the antenna system specifically includes fixing a manufactured antenna substrate 5 and the waveguide feed substrate together by bonding.

Figure 9:
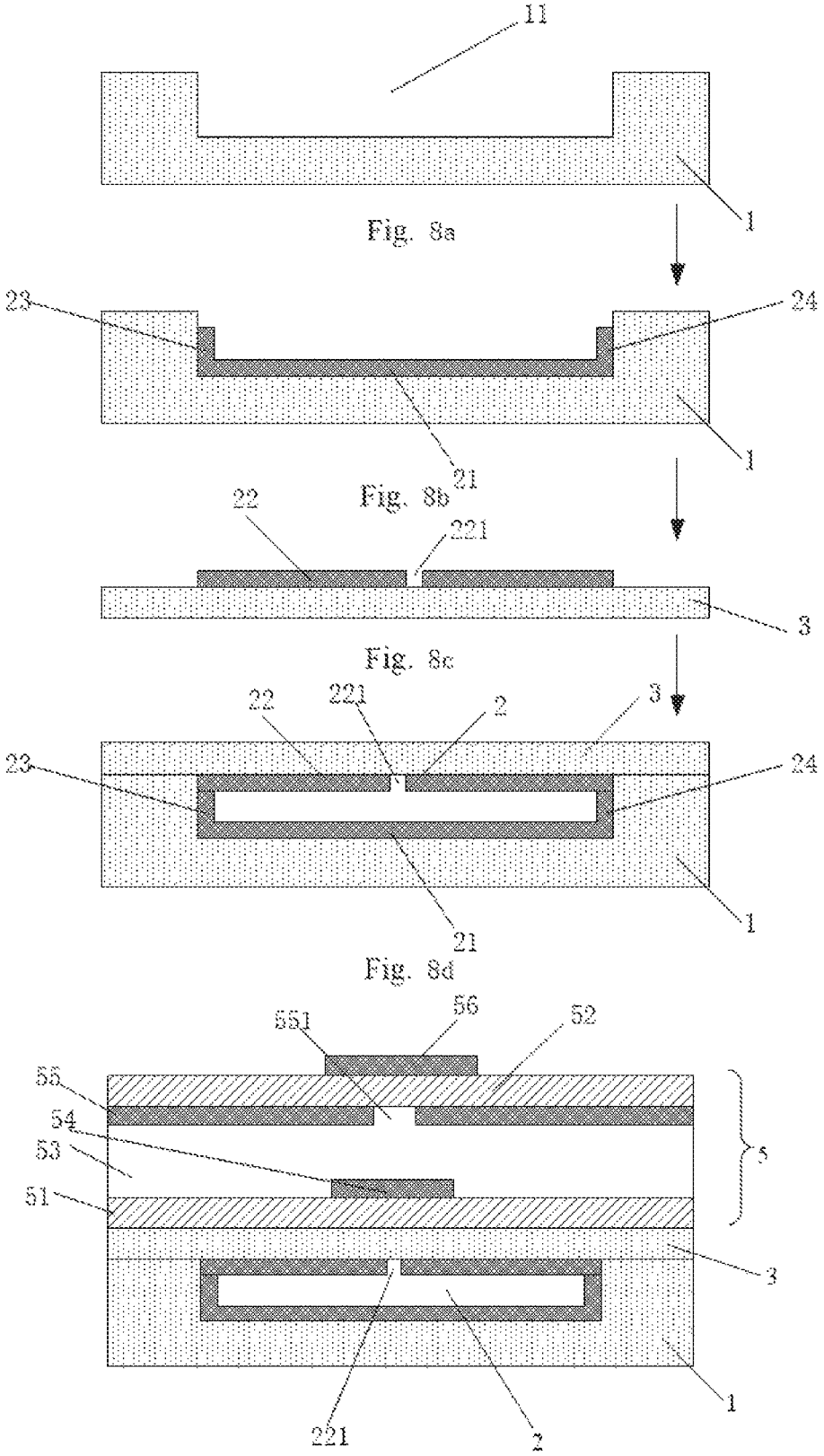
FIG. 9 is a schematic structural diagram of an antenna system according to an embodiment of the present disclosure.

FIG. 9, similar to FIG. 4*e*, shows an assembly diagram of a section structure of the antenna substrate and a section structure of the waveguide feed substrate. For example, the antenna substrate 5 consists of a phase shifter and a metal patch provided on the phase shifter. The liquid crystal phase shifter generally includes a third base substrate 51 and a fourth base substrate 52, and a liquid crystal layer 53 between the third base substrate 51 and the fourth base substrate 52. A material of the fourth base substrate 52 may be the same as that of the third base substrate 51. The liquid crystal phase shifter further includes a microstrip line 54 located on a side of the third base substrate 51 close to the liquid crystal layer 53, a patch electrode 55 disposed on a side of the fourth base substrate 52 close to the liquid crystal layer 53, and a metal patch 56 disposed on a side of the fourth base substrate 52 distal to the liquid crystal layer 53. An orthographic projection of the microstrip line 54 on the third base substrate 51 partially overlaps an orthographic projection of the opening 221 of the second side of the waveguide feed substrate on the third base substrate 51. The patch electrode 55 has an opening 551, and an orthographic projection of the metal patch 56 on the fourth base substrate 52 partially overlaps an orthographic projection of the opening 551 of the patch electrode 55 on the fourth base substrate 52. An orthographic projection of the microstrip line 54 on the fourth base substrate 52 partially overlaps the orthographic projection of the opening 551 of the patch electrode 55 on the fourth base substrate 52. An orthographic projection of the opening 221 of the second side of the waveguide feed substrate on the fourth base substrate 52 does not overlap the orthographic projection of the opening 551 of the patch electrode 55 on the fourth base substrate 52. Thus, the electromagnetic wave signal reaches the microstrip line 54 through the opening 221, then is transmitted along an axis of the microstrip line 54 to reach the opening 551, then reaches the metal patch 56 through the opening 551, and finally is radiated out by the metal patch 56.

Thus, during a bonding process, a surface of the first base substrate 1 of the waveguide feed substrate on which the waveguide feeder 2 is disposed faces a surface of the third base substrate 51 of the antenna substrate 5 distal to the microstrip line 54, so as to fix a second base substrate 3 of the waveguide feed substrate and the antenna substrate 5 together. The bonding process has high precision, and can form antenna systems having stable structures, and therefore, can greatly reduce loss and error of the antenna systems caused by mechanical assembly.

Figure 11:
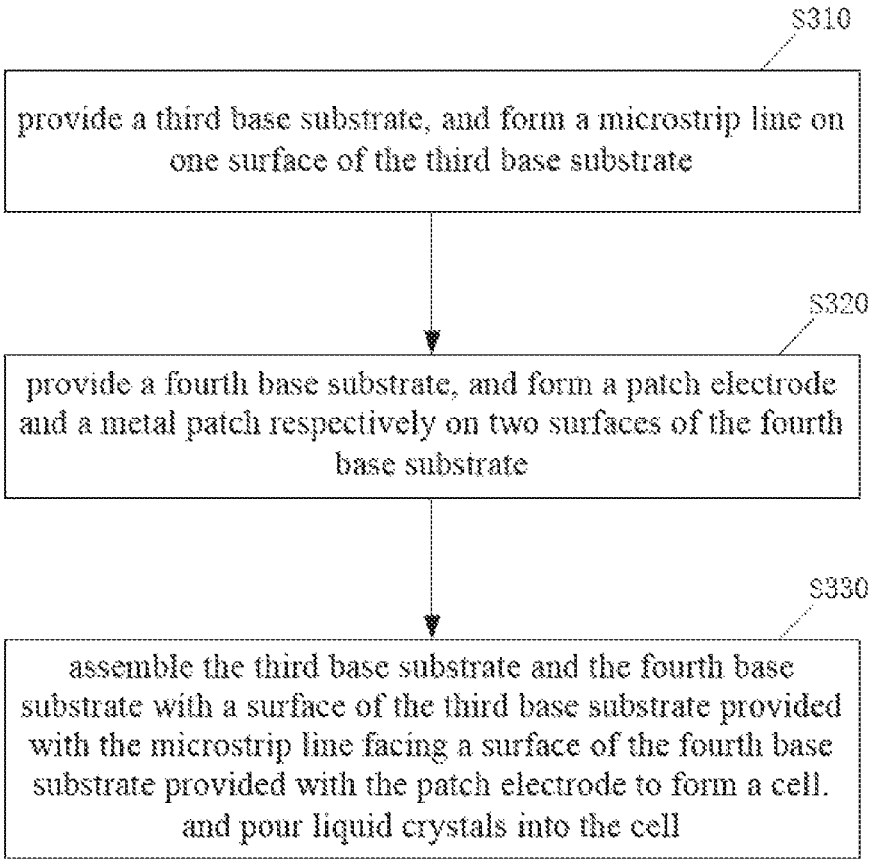
FIG. 11 is a flow chart of a method for manufacturing an antenna substrate according to an embodiment of the present disclosure.

According to an embodiment of the present disclosure, a method for manufacturing an antenna substrate is provided, and as shown in FIG. 11, the method for manufacturing the antenna substrate includes the following steps.

In step S310, a third base substrate 51 is provided, metal growth is performed on one surface of the third base substrate 51, and the grown metal is patterned to form a microstrip line 54.

In step S320, a fourth base substrate 52 is provided, metal growth is performed on two surfaces of the fourth base substrate 52, and the metal grown on the two surfaces are patterned to form a patch electrode 55 and a metal patch 56 respectively. The patch electrode 55 is provided with an opening 551, and an orthographic projection of the metal patch 56 on the fourth base substrate 52 partially overlaps an orthographic projection of the opening 551 of the patch electrode 55 on the fourth base substrate 52.

In step S330, the third base substrate 51 and the fourth base substrate 52 are assembled with a surface of the third base substrate 51 provided with the microstrip line 54 facing a surface of the fourth base substrate 52 provided with the patch electrode 55 to form a cell, and liquid crystals are poured into the cell. An orthographic projection of the microstrip line 54 on the fourth base substrate 52 partially overlaps the orthographic projection of the opening 551 of the patch electrode 55 on the fourth base substrate 52.

Corresponding to the waveguide feed substrate of FIG. 1, the upper surface of the first base substrate 1 of the waveguide feed substrate provided with the receiving groove 11 and a surface of the third base substrate in the antenna substrate 5 provided with the microstrip line 54 are fixed by a bonding process. An orthographic projection of the microstrip line 54 on the third base substrate 51 partially overlaps an orthographic projection of the opening 221 of the second side 22 of the waveguide feed substrate on the third base substrate 51, and an orthographic projection of the opening 221 of the second side of the waveguide feed substrate on the fourth base substrate 52 does not overlap the orthographic projection of the opening 551 of the patch electrode 55 on the fourth base substrate 52.

Corresponding to the waveguide feed substrate of FIG. 6, a surface of the second base substrate 3 of the waveguide feed substrate distal to the second side 22 and a surface of the third base substrate 51 not having the microstrip line 54 in the antenna substrate are fixed by a bonding process. An orthographic projection of the microstrip line 54 on the third base substrate 51 partially overlaps an orthographic projection of the opening 221 of the second side 22 of the waveguide feed substrate on the third base substrate 51, and an orthographic projection of the opening 221 of the second side 22 of the waveguide feed substrate on the fourth base substrate 52 does not overlap the orthographic projection of the opening 551 of the patch electrode 55 on the fourth base substrate 52.

It should be understood that the above embodiments are merely exemplary embodiments that are employed to illustrate the principles of the present disclosure, and that the present disclosure is not limited thereto. It will be apparent to those skilled in the art that various changes and modifications can be made without departing from the spirit and essence of the present disclosure, and should be considered to fall within the protection scope of the present disclosure.

What is claimed is:

1. A waveguide feed substrate, comprising:

a first base substrate provided with a receiving groove which is recessed from an upper surface of the first base substrate to a lower surface of the first base substrate; the receiving groove comprising a bottom, a first side wall and a second side wall which are connected to the bottom and disposed opposite to each other; and a waveguide feeder embedded in the receiving groove; the waveguide feeder being a hollow structure and provided with a first side disposed at the bottom of the receiving groove, a second side disposed opposite to the first side, and a third side and a fourth side which are both connected between the first side and the second side and disposed opposite to each other;

wherein the third side is disposed on the first side wall and the fourth side is disposed on the second side wall; an opening is disposed in the second side, the second side, where the opening is located, is entirely within the receiving groove, and an orthographic projection of the opening on the first base substrate is within an orthographic projection of the second side on the first base substrate, and an upper surface of the second side distal to the first side is flush with the upper surface of a part of the first base substrate on which the receiving groove is not provided.

2. The waveguide feed substrate according to claim 1, further comprising a second base substrate disposed on a side of the second side of the waveguide feeder distal to the first side, wherein the second base substrate is connected to the upper surface of the part of the first base substrate, on which the receiving groove is not provided, by bonding.

3. The waveguide feed substrate according to claim 2, wherein, materials of the first base substrate and the second base substrate both comprise: any one of glass, silicon, quartz, and ceramic, and a material of the waveguide feeder comprises metal.

4. An antenna system, comprising the waveguide feed substrate according to claim 1, and an antenna substrate bonded to the waveguide feed substrate.

5. The antenna system according to claim 4, wherein the antenna substrate comprises:

a third base substrate;

a microstrip line disposed on a side of the third base substrate distal to the waveguide feed substrate;

a fourth base substrate;

a patch electrode disposed on a first side of the fourth base substrate;

a metal patch disposed on a second side of the fourth base substrate; and a liquid crystal layer disposed between a side of the third base substrate provided with the microstrip line and a side of the fourth base substrate provided with the patch electrode, wherein an orthographic projection of the microstrip line on the third base substrate partially overlaps an orthographic projection of the opening of the second side of the waveguide feed substrate on the third base substrate; the patch electrode has an opening, and an orthographic projection of the metal patch on the fourth base substrate partially overlaps an orthographic projection of the opening of the patch electrode on the fourth base substrate; an orthographic projection of the microstrip line on the fourth base substrate partially overlaps the orthographic projection of the opening of the patch electrode on the fourth base substrate; and an orthographic projection of the opening of the second side of the waveguide feed substrate on the fourth base substrate does not overlap the orthographic projection of the opening of the patch electrode on the fourth base substrate.

6. The antenna system according to claim 5, wherein a material of the third base substrate comprises glass.

7. A method for manufacturing a waveguide feed substrate, the waveguide feed substrate comprising a first base substrate provided with a receiving groove, and a waveguide feeder embedded in the receiving groove, the waveguide feeder being a hollow structure and provided with a first side disposed at a bottom of the receiving groove, a second side disposed opposite to the first side and provided with an opening, and a third side and a fourth side which are both connected between the first side and the second side and disposed opposite to each other, wherein the method for manufacturing the waveguide feed substrate comprises:

providing a first base substrate, and etching the first base substrate to form a receiving groove therein; wherein the receiving groove comprises: a bottom, and a first side wall and a second side wall which are connected to the bottom and disposed opposite to each other;

growing metal on the bottom, the first side wall and the second side wall of the receiving groove to form a first side, a third side and a fourth side of a waveguide feeder;

forming a sacrificial structure that fills the receiving groove where the first side, the third side, and the fourth side of the waveguide feeder are formed, wherein an upper surface of the sacrificial structure is flush with upper surfaces of the third side and the fourth side to expose the upper surfaces of the third side and the fourth side;

forming a pattern of a second side of the waveguide feeder by a patterning process, the second side having an opening and being connected to the third side and the fourth side to form a hollow structure with the first side, the third side, and the fourth side, an upper surface of the second side distal to the first side being flush with an upper surface of the first base substrate on which the receiving groove is provided; and removing the sacrificial structure through the opening in the second side to form the waveguide feeder.

8. The method for manufacturing a waveguide feed substrate according to claim 7, wherein a material of the first base substrate comprises: any one of glass, silicon, quartz, and ceramic.

9. The method for manufacturing a waveguide feed substrate according to claim 8, wherein a material of the waveguide feeder comprises metal.

10. The method for manufacturing a waveguide feed substrate according to claim 9, wherein the step of growing metal on the bottom, the first side wall and the second side wall of the receiving groove comprises forming a metal material layer by an electroplating process to integrally form the first side, the third side and the fourth side of the waveguide feeder as a single piece.

11. The method for manufacturing a waveguide feed substrate according to claim 10, wherein the step of forming a sacrificial structure comprises depositing a sacrificial layer material on the first base substrate provided with the receiving groove where the first side, the third side and the fourth side of the waveguide feeder are formed, and removing the sacrificial layer material located outside the receiving groove to form the sacrificial structure which fully fills the receiving groove.

12. The method for manufacturing a waveguide feed substrate according to claim 11, wherein the sacrificial layer material comprises any one of silicon dioxide and polysilicon.

13. The method for manufacturing a waveguide feed substrate according to claim 12, wherein the step of forming a pattern of a second side of the waveguide feeder by a patterning process comprises depositing a metal material layer by a sputtering or electroplating process, and forming the pattern of the second side by exposure, development and etching processes.

14. The method for manufacturing a waveguide feed substrate according to claim 13, wherein the step of removing the sacrificial structure through the opening in the second side comprises: removing the sacrificial structure through the opening in the second side by an etching process.

15. A method for manufacturing a waveguide feed substrate, the waveguide feed substrate comprising a first base substrate provided with a receiving groove, and a waveguide feeder embedded in the receiving groove, wherein the waveguide feeder is a hollow structure, and is provided with a first side disposed at a bottom of the receiving groove, and a third side and a fourth side where are connected to the first side and disposed opposite to each other, and the waveguide feeder is further provided with a second side disposed opposite to the first side and the second side is provided with an opening, the second side is located on a second base substrate and is connected to the third side and the fourth side respectively, and a surface of the second base substrate on which the second side is provided is bonded to and fixed with an upper surface of the first substrate on which the receiving groove is provided;

wherein the method for manufacturing a waveguide feed substrate comprises:

providing a first base substrate, and etching the first base substrate to form a receiving groove therein; wherein the receiving groove comprises: a bottom, and a first side wall and a second side wall which are connected to the bottom and disposed opposite to each other;

growing metal on the bottom, the first side wall and the second side wall of the receiving groove to form a first side, a third side and a fourth side of a waveguide feeder;

providing a second base substrate, and forming a pattern comprising a second side of the waveguide feeder on the second base substrate by a patterning process, wherein the second side is provided with an opening, and a thickness of the second side is equal to a distance between upper surfaces of the third side and the fourth side and an upper surface of the first base substrate; and performing a bonding process on the first base substrate on which the first side, the third side and the fourth side of the waveguide feeder are formed and the second base substrate on which the second side of the waveguide feeder is formed to form the waveguide feeder, wherein the second side is connected to the third side and the fourth side to form a hollow structure with the first side, the third side and the fourth side, and the upper surface of the first base substrate is in contact with the second base substrate.

16. The method for manufacturing a waveguide feed substrate according to claim 15, wherein materials of the first base substrate and the second base substrate both comprise: any one of glass, silicon, quartz, and ceramic.

17. The method for manufacturing a waveguide feed substrate according to claim 16, wherein a material of the waveguide feeder comprises metal.

18. The method for manufacturing a waveguide feed substrate according to claim 17, wherein the step of growing metal on the bottom, the first side wall and the second side wall of the receiving groove comprises forming a metal material layer by an electroplating process to integrally form the first side, the third side and the fourth side of the waveguide feeder, and the step of forming a pattern comprising a second side of the waveguide feeder on the second base substrate by a patterning process comprises depositing a metal material layer by a sputtering or electroplating process, and forming the pattern of the second side by exposure, development, and etching processes.

19. A method for manufacturing an antenna system, the antenna system comprising a waveguide feed substrate and an antenna substrate bonded to the waveguide feed substrate, the method for manufacturing an antenna system comprising the method for manufacturing a waveguide feed substrate according to claim 7, a method for manufacturing an antenna substrate, and a method for fixing a waveguide feed substrate and an antenna substrate, wherein the method for manufacturing an antenna substrate comprises:

providing a third base substrate;

growing metal on one surface of the third base substrate, and patterning the grown metal to form a microstrip line;

providing a fourth base substrate;

growing metal on two opposite surfaces of the fourth base substrate, and patterning the metal grown on the two surfaces to form a patch electrode and a metal patch respectively, wherein the patch electrode is provided with an opening, and an orthographic projection of the metal patch on the fourth base substrate partially overlaps an orthographic projection of the opening of the patch electrode on the fourth base substrate;

assembling the third base substrate and the fourth base substrate with a surface of the third base substrate provided with the microstrip line facing a surface of the fourth base substrate provided with the patch electrode to form a cell, and pouring liquid crystals into the cell, wherein an orthographic projection of the microstrip line on the fourth base substrate partially overlaps the orthographic projection of the opening of the patch electrode on the fourth base substrate, wherein the method for fixing the waveguide feed substrate and the antenna substrate comprises fixing the upper surface of the first base substrate on which the receiving groove is provided in the waveguide feed substrate and a surface of the third base substrate not having the microstrip line in the antenna substrate by a bonding process, wherein an orthographic projection of the microstrip line on the third base substrate partially overlaps an orthographic projection of the opening of the second side of the waveguide feed substrate on the third base substrate, and an orthographic projection of the opening of the second side of the waveguide feed substrate on the fourth base substrate does not overlap the orthographic projection of the opening of the patch electrode on the fourth base substrate.

20. A method for manufacturing an antenna system, the antenna system comprising a waveguide feed substrate and an antenna substrate bonded to the waveguide feed substrate, the method for manufacturing an antenna system comprising the method for manufacturing a waveguide feed substrate according to claim 15, a method for manufacturing an antenna substrate, and a method for fixing a waveguide feed substrate and an antenna substrate, wherein the method for manufacturing an antenna substrate comprises:

providing a third base substrate;

growing metal on one surface of the third base substrate, and patterning the grown metal to form a microstrip line;

providing a fourth base substrate;

growing metal on two opposite surfaces of the fourth base substrate, and patterning the metal grown on the two surfaces to form a patch electrode and a metal patch respectively, wherein the patch electrode is provided with an opening, and an orthographic projection of the metal patch on the fourth base substrate partially overlaps an orthographic projection of the opening of the patch electrode on the fourth base substrate;

assembling the third base substrate and the fourth base substrate with a surface of the third base substrate provided with the microstrip line facing a surface of the fourth base substrate provided with the patch electrode to form a cell, and pouring liquid crystals into the cell, wherein an orthographic projection of the microstrip line on the fourth base substrate partially overlaps the orthographic projection of the opening of the patch electrode on the fourth base substrate, wherein the method for fixing the waveguide feed substrate and the antenna substrate comprises fixing a surface of the second base substrate of the waveguide feed substrate distal to the second side and a surface of the third base substrate not having the microstrip line in the antenna substrate by a bonding process, wherein an orthographic projection of the micro strip line on the third base substrate partially overlaps an orthographic projection of the opening of the second side of the waveguide feed substrate on the third base substrate, and an orthographic projection of the opening of the second side of the waveguide feed substrate on the fourth base substrate does not overlap the orthographic projection of the opening of the patch electrode on the fourth base substrate.

* * * * *